United States Patent [19]

Nightengale, Jr.

[11] 3,994,409

[45] Nov. 30, 1976

[54] EASY OPENING CLOSURE

[76] Inventor: Richard C. Nightengale, Jr., 2234 S. Flower St., Santa Ana, Calif. 92707

[22] Filed: June 6, 1975

[21] Appl. No.: 584,363

[52] U.S. Cl. ..... 215/256; 215/258; 215/306

[51] Int. Cl.² ..... B65D 41/48

[58] Field of Search ..... 215/254, 256, 257, 258, 215/306; 220/269, 270, 276

[56] References Cited

UNITED STATES PATENTS

| | | | |
|---|---|---|---|
| 3,235,117 | 2/1966 | Mason | 215/256 |
| 3,622,028 | 11/1971 | Lohrer | 215/320 X |
| 3,904,062 | 9/1975 | Grussen | 215/258.X |

FOREIGN PATENTS OR APPLICATIONS

| | | | |
|---|---|---|---|
| 716,420 | 8/1965 | Canada | 215/254 |
| 1,164,846 | 5/1958 | France | 215/306 |
| 684,795 | 3/1965 | Italy | 215/254 |

*Primary Examiner*—Donald F. Norton
*Attorney, Agent, or Firm*—Gordon L. Peterson

[57] ABSTRACT

An easy opening closure comprising an end wall, a peripheral wall joined to the end wall, and a tear strip on the peripheral wall. The tear strip extends generally circumferentially of the peripheral wall and divides the closure into a closure section and a retainer section. The tear strip is completely removable from one of the sections without removing the tear strip from the other of the sections so that the sections can be separated with the tear strip remaining attached to such other section.

10 Claims, 4 Drawing Figures

EASY OPENING CLOSURE

BACKGROUND OF THE INVENTION

One type of easy opening closure typically includes an end wall adapted to close the opening in a container and a peripheral wall for attaching the closure to the container. The peripheral wall is scored to define a tear strip which can be removed to permit removal of the closure. In some instances, the closure is designed so that it can be used to reclose the container.

For example, the U.S. Pat. to Sebell No. 2,415,609 shows an easy opening closure having a tear strip in the peripheral wall of the closure. The tear strip can be completely removed and discarded leaving a cap member attached to a band member by a hinge. The band member holds the cap member on the container, and the cap member can be used to reclose the container. However, during use the hinge is repeatedly deformed so that it would tend to fracture thereby becoming useless for its intended purpose. In addition, the tear strip is completely severed from the closure and must be separately discarded. This increases the likelihood that the use of the closure shown in the Sebell patent will result in litter.

U.S. Pat. No. 3,235,117 issued to Mason shows a similar construction in that the peripheral wall has a tear strip which must be completely removed and discarded before the cap member can be removed. A separate attaching arm is used to attach the band to the cap member. The use of this container would also tend to add to the litter problem. In addition, the separate attaching member adds to the cost of the closure.

SUMMARY OF THE INVENTION

With the present invention, the tear strip is formed on the peripheral wall and it divides the closure into a closure section and a retainer section. The tear strip is completely removable from one of the sections without removing the tear strip from the other of the sections. This enables the closure section to be removed from the retainer section, but requires that the tear strip remain with one of the sections. By so doing, the tear strip creates no separate litter problem.

Another feature of the present invention is that the tear strip can be utilized to affix the closure section to the retainer section to prevent loss or dropping of the closure section. In other words, a portion of an easy opening container which is commonly discarded, i.e. the tear strip, is utilized in the present invention to perform a useful and valuable function. This eliminates the need for a special attaching member. In addition, the tear strip, unlike a hinge, is not subject to fracture during use.

The tear strip can advantageously be defined by a line of weakness in the peripheral wall. Depending upon the configuration of the line of weakness, the tear strip can be caused to remain with either the closure section or the retainer section. In order that the tear strip can be completely removed from one of these section, the line of weakness preferably includes first line of weakness which extends completely around the peripheral wall. In order that the tear strip can remain with the other of the sections, the line of weakness preferably includes a second line of weakness extending circumferentially of the peripheral wall and having spaced apart ends. The material of the peripheral wall between the spaced apart ends integrally joins the tear strip to one of the sections. To facilitate initiation of the tear strip removal process, the first and second lines of weakness are preferably joined together at a starting location. To further facilitate removal of the tear strip, a tab can be joined to the tear strip adjacent the starting location.

Assuming that the line of weakness is formed so as to leave the tear strip integrally joined to the closure section, the tear strip can be attached to the retainer section utilizing any suitable means. For example, the retainer section may include a tab and an opening can be formed in one of the tab and the tear strip. The other of the tab and the tear strip can be forced through the opening to attach the tear strip to the retainer section. This provides added flexibility for the user in that the user has a choice as to whether or not he will attach the tear strip to the retainer section.

Cooperating means are formed on the container and the closure section for releasably attaching the closure section to the container. This enables the closure section to be used to reclose the container. Cooperating means are also provided on the retainer section and the container for retaining the retainer section on the container.

The closure also cooperates with the container in a novel way to improve the sealing effectiveness of the closure. To this end, the container includes an annular flange extending radially inwardly adjacent the end wall of the closure. The closure includes means defining an annular groove opening radially outwardly and receiving a portion of the flange. This cooperation between the groove and flange improves the sealing effectiveness of the closure.

The invention can best be understood by reference to the following description taken in connection with the accompanying illustrative drawing.

DESCRIPTION OF THE PREFERRED EMBODIMENT

Figure 1:
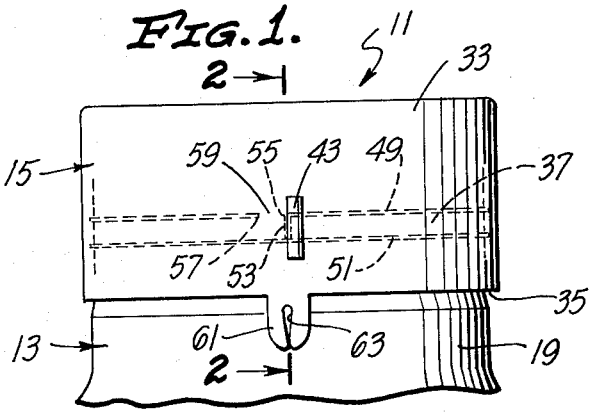
FIG. 1 is a fragmentary elevational view of an easy opening container constructed in accordance with the teachings of this invention.

FIG. 1 shows an easy opening container 11 which includes a container 13 and an easy opening closure 15. Although the container 13 can be of various different designs, in the embodiment illustrated, it is in the form of a bottle constructed of plastic material such as polyethylene and useable for containing milk.

Figure 2:
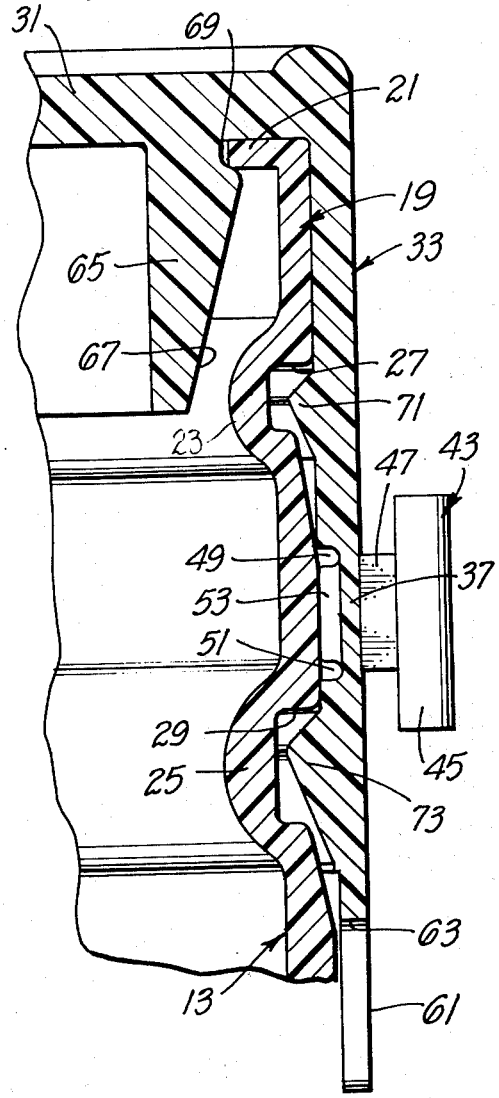
FIG. 2 is an enlarged, fragmentary, sectional view taken generally along line 2—2 of FIG. 1.
Figure 4:
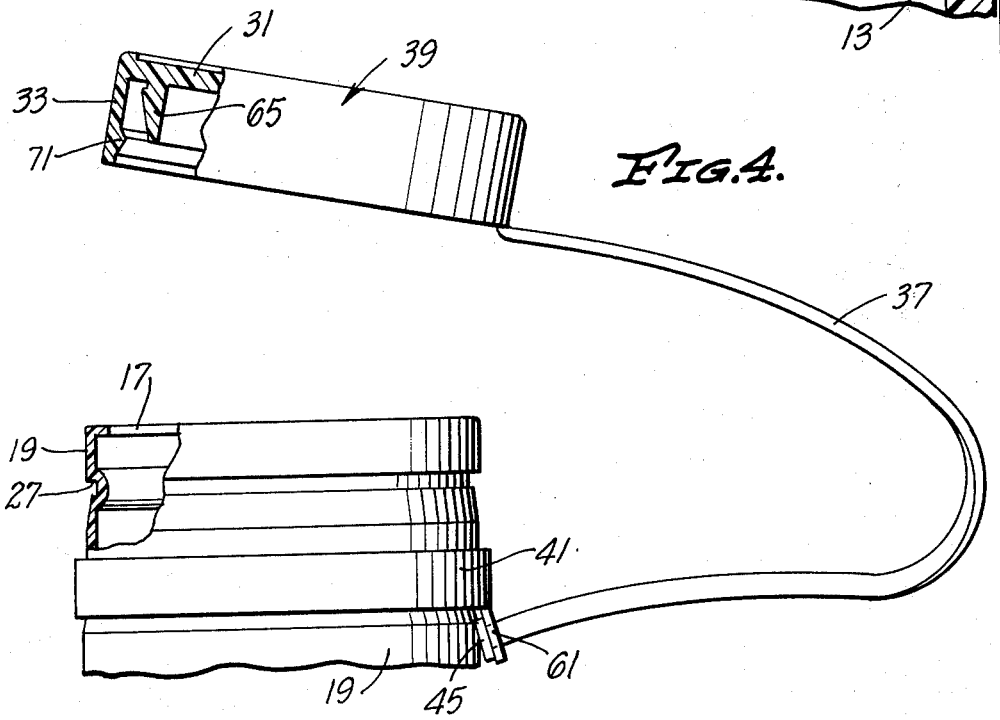
FIG. 4 is an elevational view partially in section showing the use of the tear strip in attaching the closure section to the retainer section.

With reference to FIGS. 2 and 4, the container 13 has an opening 17 and a peripheral wall 19. An annular flange 21 extends radially inwardly in a radial plane from the upper end of the peripheral wall 19. The peripheral wall 19 has annular beads 23 and 25 which project radially inwardly. The beads 23 and 25 have outwardly opening annular grooves 27 and 29, respectively, in their outer surfaces.

This closure 15 includes an end wall 31 and an annular peripheral wall 33 integrally joined to the end wall and projecting transversely therefrom. Although the closure 15 could be constructed of different materials, in the embodiment illustrated, it is constructed of molded plastic material. The peripheral wall 33 terminates in a lower edge 35 (FIG. 1) which is remote from the end wall 31.

Figure 3:
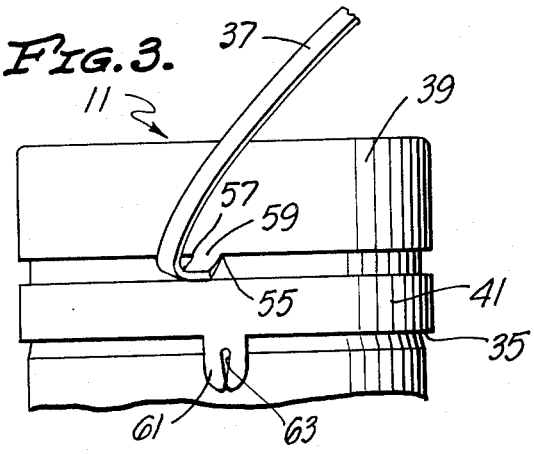
FIG. 3 is an elevational view similar to FIG. 2 showing the tear strip being removed.

A tear strip 37 is formed in the peripheral wall 33. The tear strip 37 divides the closure 15 into a closure section 39 and a retainer section 41 (FIGS. 3 and 4). The closure section 39 forms a cap and the retainer section 41 is in the form of a band extending around the peripheral wall 19.

A tab 43 is molded integrally with the tear strip 37 and is affixed thereto. Although the tab could be of various different constructions, in the embodiment illustrated, it includes a handle 45 adapted to be manually grasped and an attaching ear 47 (FIG. 2) for attaching the handle to the tear strip.

The tear strip 37 can be defined in any manner which will permit it to be torn completely free from one of the sections 39 and 41 without separating it from the other of the sections 39 and 41. In the embodiment illustrated, the tear strip 37 can be completely separated from the retainer section 41 without separation from the closure section 39. However, this could be reversed if desired.

In the embodiment illustrated, the tear strip 37 is defined by a line of weakness which includes a first circumferential line of weakness 49, a second circumferential line of weakness 51, and a connector line of weakness 53. In the embodiment illustrated, the lines of weakness 49, 51 and 53 extend continuously to facilitate tearing of the material along the lines of weakness; however, it would be possible to have the lines of weakness extend in interrupted fashion. The lines of weakness 49, 51 and 53 are formed on the interior surface of the peripheral wall 33; however, some or all of them could be formed on the exterior surface of the peripheral wall 33, if desired. As best shown in FIG. 2, the thickness of the material of the peripheral wall 33 is substantially reduced along the lines of weakness. x In order to assure that the tear strip 37 can be completely torn free of the retainer section 41, the line of weakness 51 extends completely around, i.e. 360° around the peripheral wall 33. In the embodiment illustrated, the line of weakness 51 describes a radial plane. To assure that the tear strip 37 will not be completely torn free of the closure section 39, the line of weakness 49 has two ends 55 and 57 (FIGS. 1 and 3), and these ends are spaced apart to define an attaching region 59. In the embodiment illustrated, the ends 55 and 57 are spaced circumferentially because the line of weakness 49 extends around the peripheral wall 33 for slightly less than 360°. However, the ends 55 and 57 may be spaced axially or in any other manner which will provide a region of attachment between the tear strip 37 and the closure section 39.

To facilitate initiation of severance of the tear strip 37 from the remainder of the closure 15, the connector line of weakness 53 is provided. The line of weakness 53 extends from the end 55 of the line of weakness 49 generally axially to the line of weakness 51. However, the connector line of weakness 53 can be of any configuration including rounded or pointed so long as it appropriately joins the lines of weakness 49 and 51. In the embodiment illustrated, the lines of weakness 49 and 51 are circular and parallel; however, this relationship is not critical.

The retainer section 41 has an ear or tab 61 extending downwardly from the lower edge 35. The tab 61 has a downwardly opening slot 63. The tab 61 is used as described hereinbelow for attaching the tear strip 37 to the retainer section 41.

The closure 15 also has an annular internal wall 65 which extends generally axially inwardly from the end wall 31 (FIG. 2). The wall 65 has a conical outer surface 67 spaced radially inwardly from the peripheral wall 33. The upper outer end of the wall 65 cooperates with the internal surface of the end wall 31 to define an annular recess or groove 69 which opens radially outwardly.

With the closure 15 installed on the container 13, the end wall 31 spans and seals the opening 15. The peripheral wall 33 snugly surrounds the upper portion of the peripheral wall 19 of the container. The closure 15 is held on the container 13 in this position by a pair of annular ribs 71 and 73 on the peripheral wall 33 which extend radially inwardly into the grooves 27 and 29, respectively. An inner annular region of the flange 21 is snugly received within the groove 69 to help seal the opening 17.

To open the container 13, the user grasps the handle 45 of the tab 43 and pulls radially outwardly to initiate severance of the peripheral wall 33 along the connector line of weakness 53 and along the adjacent portions of the lines of weakness 49 and 51. By continuing this outward pulling force, the peripheral wall 33 is completely severed along the line of weakness 51 to thereby separate the tear strip 37 and the closure section 39 from the retainer section 41. However, because the ends 55 and 57 of the line of weakness 49 are spaced apart, the attaching region 59 is not ruptured. Accordingly, the tear strip 37 remains affixed to the closure section 39 as shown in FIG. 3. The ends 55 and 57 may be curved, axially offset, provided with barrier dimples, or with any other means to inhibit tearing of the peripheral wall 33 therebetween, if desired.

The closure section 39 with the tear strip 37 attached thereto can then be manually removed from the upper end of the container 13. The peripheral walls 19 and 33, the annular flange 21 and the interior wall 65 are sufficiently resiliently deformable to allow removal of the closure section 39. The retainer section 41 remains affixed to the container 13 by virtue of the cooperation between the rib 73 and the groove 29.

With the closure section 39 removed, the tear strip 37 can be used to attach the closure section to the retainer section 41. This can be accomplished by inserting the region of the tear strip adjacent the ear 47 into the slot 63 as shown in FIG. 4. This places the handle 45 between the tab 61 and the outer surface of the peripheral wall 19. The resilience of the tab 61 coupled with the clamping of the handle 45 between the tab 61 and the peripheral wall 19 are sufficient to attach the tea strip 37 to the retainer section 41.

With the closure section 39 attached to the retainer section 41, it cannot be lost. Moreover, the closure section 39 can be used as often as desired to reclose the opening 17. Of course, the attachment of the tear strip 37 to the retainer section 41 is optional with the user. In any event, the tear strip 37 remains integral with the closure section 39 so that it cannot be a separate source of litter.

Although the closure 15 illustrated is integrally molded from plastic material, other materials and construction can be utilized. Terms such as "upper" and "lower" are used herein merely to conform to the orientation of the easy opening container 11 shown in the drawing and should not be considered as limiting. Obviously, the easy opening closure 15 can be used in any spatial orientation.

Although an exemplary embodiment of the invention has been shown and described, many changes, modifications and substitutions can be made by those with ordinary skill in the art without necessarily departing from the spirit and scope of this invention.

I claim:

1. An easy opening closure comprising:

an end wall;

a peripheral wall joined to the end wall and extending generally transversely of the end wall;

first means defining a tear strip on the peripheral wall, said strip extending generally circumferentially of the peripheral wall and dividing the closure into a closure section and a retainer section, said tear strip being completely removable from one of said sections without removing the tear strip from the other of said sections whereby said sections can be separated with the tear strip remaining attached to said other section;

said first means including first and second lines of weakness extending circumferentially on the peripheral wall;

said first line of weakness facilitating removal of the tear strip from said one section along a path which extends circumferentially from one location completely around the peripheral wall back to said first location;

said second line of weakness having first and second spaced apart ends whereby the material of the peripheral wall between said ends attaches the tear strip to said other section; and second means for attaching the tear strip to said one section after said sections have been separated.

2. An easy opening closure as defined in claim 1 wherein said one section is the retainer section.

3. An easy opening closure as defined in claim 2 wherein said retainer section has a lower edge and said second means includes a tab extending downwardly from said lower edge and an opening in one of said tab and said tear strip, a portion of the other of said tab and said tear strip being receivable in said opening to attach the tear strip to said retainer section.

4. An easy opening closure as defined in claim 3 wherein said opening is in said tab.

5. An easy opening closure as defined in claim 1 wherein said second means includes a tab on said one section and an opening in one of said tab and said tear strip, a portion of the other of said tab and said tear strip being receivable in said opening to attach the tear strip to said one section.

6. An easy opening closure as defined in claim 1 wherein said first line of weakness is endless and extends from said first location completely around the peripheral wall back to said first location and defines along its full length one edge of the tear strip.

7. An easy opening closure as defined in claim 1 wherein said peripheral wall has an inner surface and an outer surface, said lines of weakness being formed on the inner surface, said closure including handle means joined to the tear strip and projecting from said outer surface.

8. An easy opening closure as defined in claim 1 including an annular wall joined to said end wall and projecting generally axially thereof radially inwardly of the peripheral wall, said end wall and said annular wall defining an annular groove opening radially outwardly.

9. An easy opening closure comprising:

an end wall;

a peripheral wall joined to the end wall and extending generally transversely of the end wall;

first means defining a tear strip on the peripheral wall, said tear strip extending generally circumferentially of the peripheral wall and dividing the closure into a closure section and a retainer section, said tear strip being completely removable from one of said sections without removing the tear strip from the other of said sections whereby said sections can be separated with the tear strip remaining attached to said other section, said one section being said retainer section, said retainer section having a lower edge;

a tab extending downwardly from said lower edge, said tab having an opening therein;

handle means on said tear strip adapted to be manually grasped to remove the tear strip from said retainer section; and a portion of the tear strip adjacent the handle means being receivable in said opening in the tab after the tear strip is removed from said retainer section to attach the tear strip to the retainer section with said handle means assisting to resist removal of the tear strip from the tab.

10. An easy opening closure comprising:

an end wall;

a peripheral wall joined to the end wall and extending generally transversely of the end wall;

first means defining a tear strip on the peripheral wall, said strip extending generally circumferentially of the peripheral wall and dividing the closure into a closure section and a retainer section, said tear strip being completely removable from one of said sections without removing the tear strip from the other of said sections whereby said sections can be separated with the tear strip remaining attached to said other section;

said retainer section forming a band and having a lower edge;

said first means including first and second lines of weakness extending circumferentially on the peripheral wall;

said first line of weakness facilitating removal of the tear strip from said one section along a path which extends circumferentially from one location completely around the peripheral wall back to said first location; and said second line of weakness having first and second spaced apart ends whereby the material of the peripheral wall between said ends attaches the tear strip to said other section, said ends being spaced by material of the peripheral wall from said lower edge so that severance of the material of the peripheral wall along the second line of weakness leaves the band formed by the retainer section unbroken.

* * * * *